US009485594B2

(12) United States Patent
Grossman et al.

(10) Patent No.: US 9,485,594 B2
(45) Date of Patent: Nov. 1, 2016

(54) CONNECTOR ARRANGEMENT IN HEARING INSTRUMENTS

(71) Applicant: Knowles Electronics, LLC, Itasca, IL (US)

(72) Inventors: Alexander Grossman, Schaumburg (IL); Joseph Heidenreich, Lake Zurich, IL (US); Matthew Manley, Crystal Lake, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 14/808,378

(22) Filed: Jul. 24, 2015

(65) Prior Publication Data

US 2016/0044428 A1 Feb. 11, 2016

Related U.S. Application Data

(60) Provisional application No. 62/033,871, filed on Aug. 6, 2014.

(51) Int. Cl.
*H04R 25/00* (2006.01)
*H04R 31/00* (2006.01)

(52) U.S. Cl.
CPC ..... *H04R 25/608* (2013.01); *H04R 25/65* (2013.01); *H04R 31/006* (2013.01); *H04R 2225/021* (2013.01); *H04R 2225/025* (2013.01)

(58) Field of Classification Search
CPC .. H04R 25/604; H04R 25/658; H04R 25/60; H04R 25/65; H04R 25/602; H04R 25/652; H04R 2225/021; H04R 25/456; H04R 25/608; H04R 2225/025; H04R 2225/49; H04R 2225/63; H04R 25/554; H04R 25/656; H04R 25/556; H04R 25/558; H04R 1/1016; H04R 2225/023; H04R 25/00
USPC ..... 381/322, 324, 312
See application file for complete search history.

(56) References Cited

U.S. PATENT DOCUMENTS 4,592,087 A 5/1986 Killion
4,689,819 A 8/1987 Killion (Continued)

FOREIGN PATENT DOCUMENTS

CN 204118900 1/2015
CN 204190936 3/2015

(Continued)

OTHER PUBLICATIONS

International Search Report and Written Opinion for PCT/US2015/042665 dated Nov. 5, 2015 (9 pages).

*Primary Examiner* — Davetta W Goins
*Assistant Examiner* — Phylesha Dabney
(74) *Attorney, Agent, or Firm* — Fitch, Even, Tabin & Flannery LLP

(57) ABSTRACT

An acoustic apparatus includes a mechanical shell, a first electronic component, a first connector, and a receiver. The mechanical shell is generally cylindrical in shape and forms a cavity, the shell having an inner surface, the inter surface in communication with the cavity. The first electronic component is disposed in the cavity. The first connector includes electrical contacts and is disposed on the inner surface of the shell. A first electrical connection electrically couples the microphone to the first connector. The receiver is disposed in the cavity, and the receiver has a second connector. An electrical connection is formed between the first electronic component and the receiver via the first connector and the second connector. A rotation of the shell causes the electrical contacts to rotate within or with respect to the second connector such that the rotation does not cause the electrical connection between the first connector and the second connector to be broken.

20 Claims, 5 Drawing Sheets

(56) References Cited

U.S. PATENT DOCUMENTS

| | | | |
|---|---|---|---|
| 5,083,095 | A | 1/1992 | Madaffari |
| 5,193,116 | A | 3/1993 | Mostardo |
| 5,297,075 | A | 3/1994 | Peters |
| 5,337,011 | A | 8/1994 | French |
| 5,353,244 | A | 10/1994 | Peters |
| 5,446,413 | A | 8/1995 | Loeppert |
| 5,559,892 | A | 9/1996 | Boor |
| 5,579,398 | A | 11/1996 | Ewens |
| 5,861,779 | A | 1/1999 | Loeppert |
| 5,990,425 | A | 11/1999 | McSwiggen |
| 6,028,502 | A | 2/2000 | McSwiggen |
| 6,307,944 | B1 | 10/2001 | Garratt |
| 6,861,604 | B2 | 3/2005 | McSwiggen |
| 6,972,386 | B1 | 12/2005 | McSwiggen |
| 7,092,538 | B2 | 8/2006 | Potter |
| 7,136,497 | B2 | 11/2006 | McSwiggen |
| 7,162,381 | B2 | 1/2007 | Boor |
| 7,221,766 | B2 | 5/2007 | Boor |
| 7,317,997 | B2 | 1/2008 | Boor |
| 7,352,876 | B2 | 4/2008 | Boor |
| 7,688,987 | B2 | 3/2010 | Boor |
| 7,706,559 | B2 | 4/2010 | Collins |
| 8,073,153 | B2 | 12/2011 | Loeppert |
| 8,123,547 | B2 | 2/2012 | Miller |
| 8,604,880 | B2 | 12/2013 | Boor |
| 8,682,015 | B2 | 3/2014 | Miller |
| 8,687,823 | B2 | 4/2014 | Loeppert |
| 8,750,548 | B2 * | 6/2014 | Christensen ..... H04R 25/55 381/322 |
| 8,798,304 | B2 | 8/2014 | Miller |
| 8,890,615 | B2 | 11/2014 | Boor |
| 2001/0036287 | A1 | 11/2001 | Beard |
| 2003/0128856 | A1 | 7/2003 | Boor |
| 2004/0179702 | A1 | 9/2004 | Boor |
| 2004/0179703 | A1 | 9/2004 | Boor |
| 2005/0078841 | A1 | 4/2005 | Boor |
| 2005/0213787 | A1 | 9/2005 | Collins |
| 2006/0067544 | A1 | 3/2006 | Moraghan |
| 2007/0217628 | A1 | 9/2007 | Boor |
| 2007/0223735 | A1 | 9/2007 | LoPresti |
| 2009/0304216 | A1 | 12/2009 | Hansen |
| 2010/0098284 | A1 | 4/2010 | Conklin |
| 2010/0111340 | A1 | 5/2010 | Miller |
| 2010/0128905 | A1 | 5/2010 | Warren et al. |
| 2012/0045912 | A1 | 2/2012 | Dai et al. |
| 2013/0058506 | A1 | 3/2013 | Boor |
| 2013/0259279 | A1 | 10/2013 | Hong |
| 2014/0097906 | A1 | 4/2014 | Jennings |
| 2014/0112516 | A1 | 4/2014 | Jiles |
| 2015/0117675 | A1 | 4/2015 | Jennings |

FOREIGN PATENT DOCUMENTS

| | | |
|---|---|---|
| CN | 204291355 | 4/2015 |
| KR | 20-2009-0009617 U | 9/2009 |

* cited by examiner

CONNECTOR ARRANGEMENT IN HEARING INSTRUMENTS

CROSS REFERENCE TO RELATED APPLICATION

This patent claims benefit under 35 U.S.C. §119 (e) to U.S. Provisional Application No. 62/033,871 entitled "Connector arrangement in hearing instruments" filed Aug. 6, 2014, the content of which is incorporated herein by reference in its entirety.

TECHNICAL FIELD

This disclosure relates to receivers and the configuration of internal components of these receivers.

BACKGROUND

Receivers are used in many of today's electronic devices. A receiver converts electrical signals representing voice into acoustic energy that is presented for listening to a user. For example, receivers can be used in hearing instruments, personal computers, cellular phones to mention a few examples.

Microphones are also used in today's electronic devices. Microphones receive acoustic energy and convert it into an electrical signal. The electrical signal can be processed by other devices as well.

Hearing instruments typically use both receivers and microphones. For example, the microphone receives an acoustic signal and converts it into an electrical signal. The signal may be further processed and then sent to a receiver. The receiver converts the electrical signal into sound energy and presents this sound energy to a listener.

There are various types of hearing instruments available and their components are positioned at different locations. For example, behind-the-ear (BTE) components such as power supplies or receivers are disposed behind the ear of a user. In-the-ear (ITE) hearing instruments are disposed in the ear of the user.

In any case, the components in the hearing instrument are coupled together so that they may communicate with each other. However, during use the hearing instrument is subjection to vibrations as the user moves. Consequently, connections between the components might become broken.

Previous approaches have not adequately addressed these problems. As a result, some user dissatisfaction has resulted from these previous approaches.

BRIEF DESCRIPTION OF THE DRAWINGS

For a more complete understanding of the disclosure, reference should be made to the following detailed description and accompanying drawings wherein.

Figure 1:
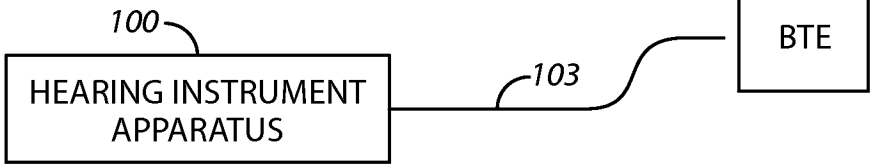
FIG. 1 is a block diagram of a hearing instrument system.
Figure 2:
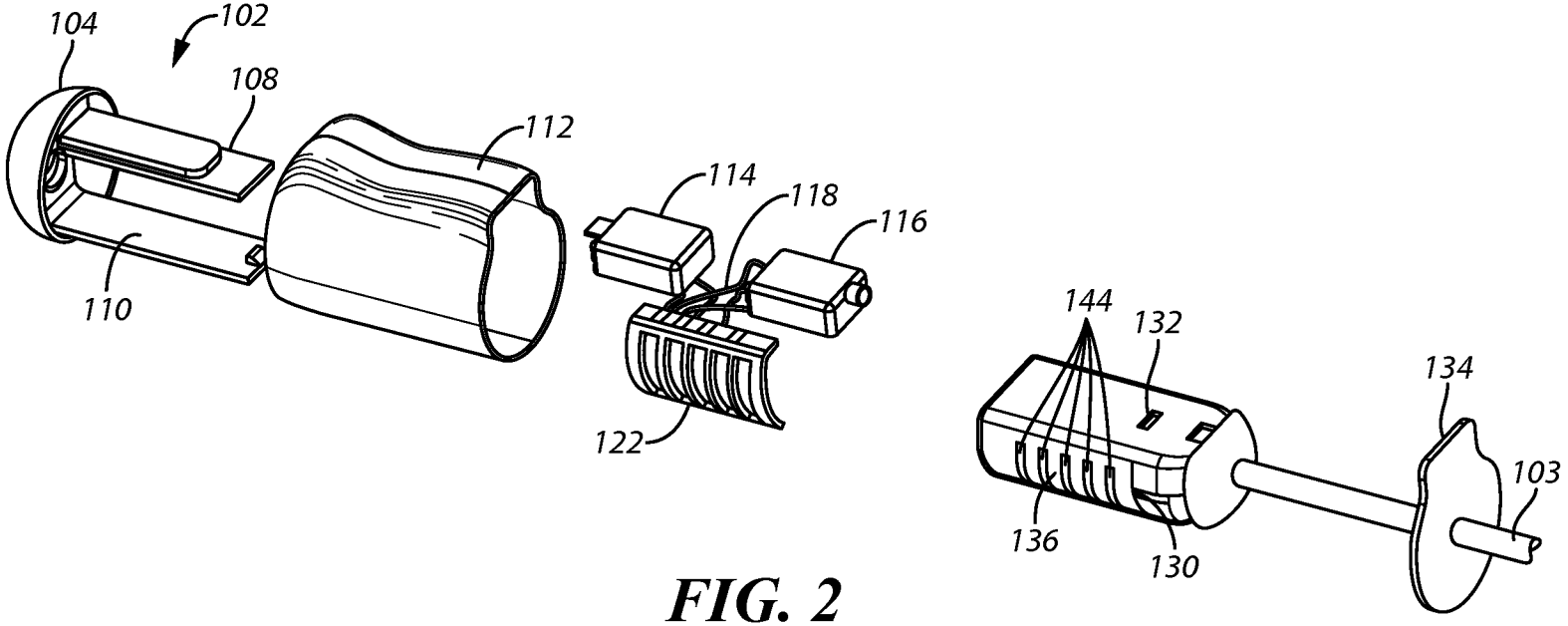
FIG. 2 is an exploded perspective diagram of a hearing instrument with an electrical connector.
Figure 3A:
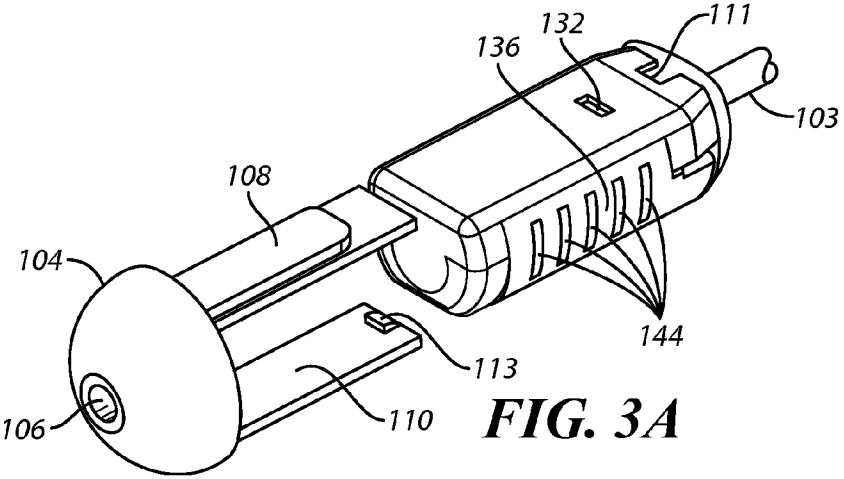
FIG. 3A and FIG. 3B are perspective drawings of the receiver and the tip portion of the hearing instrument of FIG. 1.
Figure 3B:
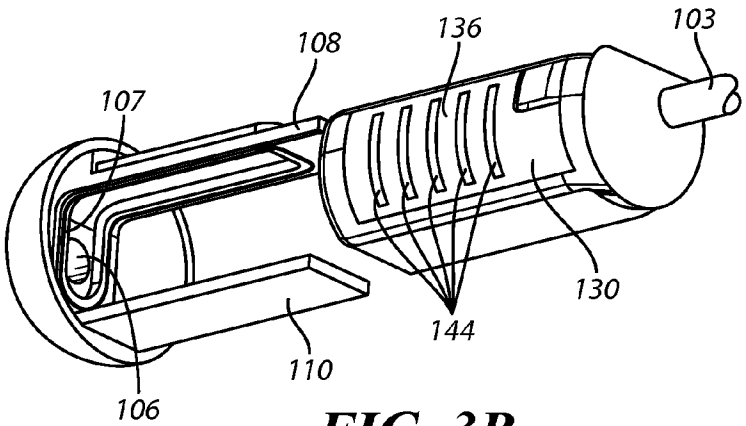
Figure 4A:
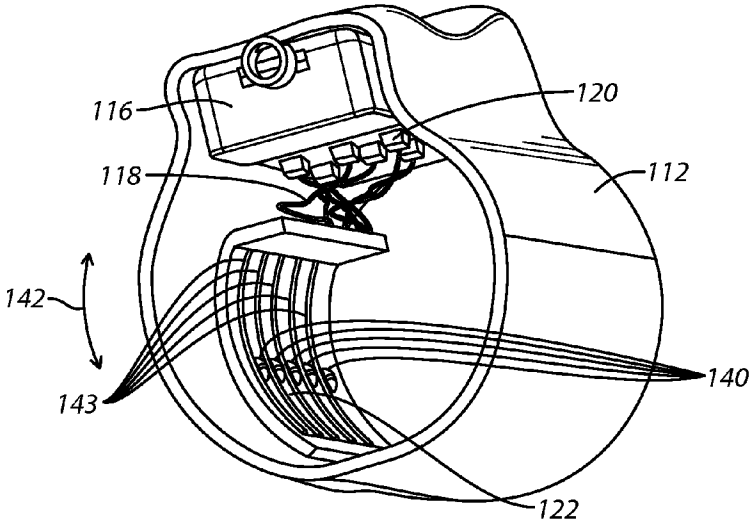
FIG. 4A and FIG. 4B are perspective drawings of the shell with a portion of the electrical connector.
Figure 4B:
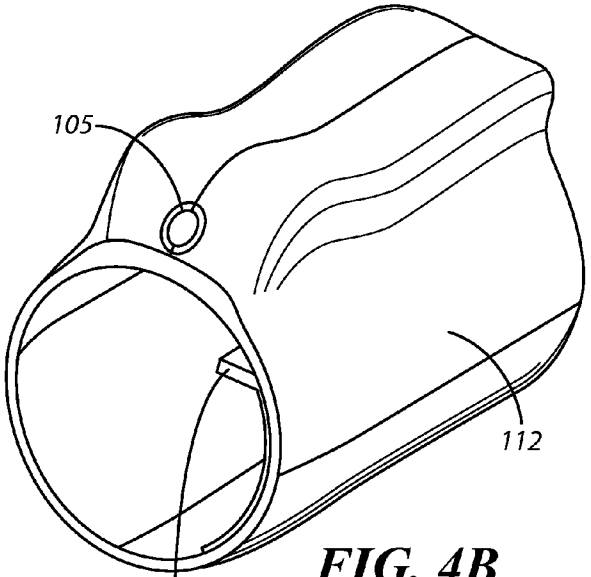

Those of ordinary skill in the art will appreciate that elements in the figures are illustrated for simplicity and clarity. It will be appreciated further that certain actions and/or steps may be described or depicted in a particular order of occurrence while those of ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

In one aspect, the present approaches provide a connector arrangement between electronic devices and a receiver within a shell of a hearing instrument. Advantageously, when the shell is rotated, the connection between the electronic devices is maintained. In other words, rotation of the shell does not cause the electrical connection between the devices and the receiver to be broken.

Referring now to FIGS. 1-5, one example of a hearing instrument apparatus 100 with a connector arrangement is described.

The hearing instrument 100 is coupled to a behind-the-ear (BTE) component 101 by a connector 103. Alternatively, the connection may be a wireless connection. The hearing instrument 100 and the BTE component 101 include or house other components as described elsewhere herein.

The apparatus 100 includes a tip 102. The tip 102 includes an end portion 104 having an opening 106 extending therethrough. Coupled to the end portion 104 are a first tab 108 and a second tab 110. A gasket is formed on the tip 106 and underside of tab 108 to form an acoustic seal for a reverse port 132 on a receiver 130. A tab 113 may latch onto the receiver and another tab (not shown) may latch onto indent 111 to secure the receiver 130 in place.

The tip 102 is disposed partially within a shell 112 so that the end portion extends out of the shell. The shell 112 is constructed of any appropriate material such as plastic or foam and may be customized in shape, dimensions, or other characteristics for a particular user. A port 105 is formed through the shell 102.

A first electronic component 114 and a second electronic component 116 are disposed between and may couple to the first tab 108 and the shell 112. The first tab 108 and the second tab 110 hold the receiver 130. The first electronic component 114 and the second electronic component 116 may be a microphone, digital signal processor (DSP), application specific integrated circuit (ASIC), to mention a few examples. Connectors 120 couple the first electronic component 114 and the second electronic component 116 to wires 118. The wires 118 couple to a connector 122. A face plate 134 attaches to shell 102 to seal the end of the shell. A connector 136 is disposed on the receiver 130 and couples to internal components of the receiver 130. Thus, the connector 122 (on the shell 112) couples to the connector 136 (on the receiver 130).

It will be appreciated that all the electronic devices are located in the shell and are not located in the BTE component 101. For example, only the power component for the circuit may be located in the BTE component 101. That is, the receivers, microphones, chips, ASICs, and other processing elements are disposed in the shell 102, which itself is disposed in the ear.

The connector 122 includes electrical contacts 140 disposed on conductors 143. The connector 136 includes conductors 144. The conductors 144 are disposed and lay generally vertically in direction across the outer (circumferential) surface of the receiver 130. The conductors 144 may be small strips of metal attached to the receiver 130. The conductors 144 may also be disposed in grooves or any type of appropriate conductive surface. The conductors 144 align with the contacts 140 of the connector 122.

It will be appreciated that as the shell 112 rotates (in the direction indicated by the arrow labeled 142), the contacts 140 also rotate in the same direction 142. But, the contacts 140 also rotate or move within or in conjunction with the conductors 144 on the receiver 130. Thus, even in the presence of rotation of the shell 112, electrical contact between the first electronic component 114 and a second electronic component 116, and the receiver 130 is not broken and is maintained.

In one example of the operation of the system described herein, sound enters through the port 105. The sound is converted into electrical signals by the first electronic component 114 and/or a second electronic component 116, which may be one or more microphones or other signal processing circuitry. Once processed, the wires carry the electrical signals to contacts 120, through wires 118, to connector 122 and to contacts 140 on the connector 122. These couple to conductors 144 on the receiver 130.

The receiver 130 converts the signals to acoustic/sound energy, which exits through opening 106 via pathway 139. It will be appreciated that all processing functionality may be contained within the shell 102 (which fits in the ear) and some other functions (e.g., a power supply) may be disposed in the BTE component 101. However, it will also be understood that these functions can also be spread between these different locations as well.

Figure 5:
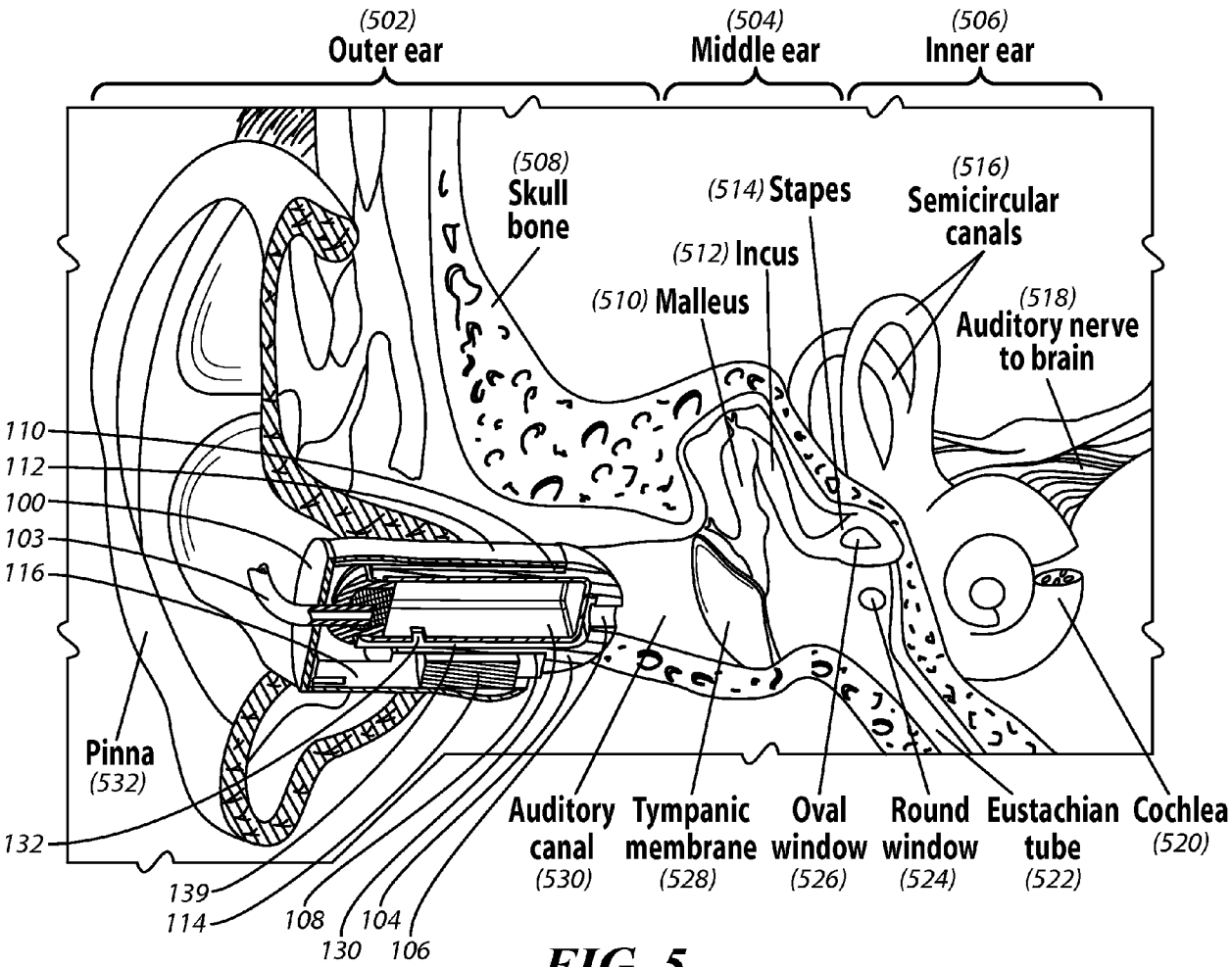
FIG. 5 is a side cut-away drawing of the hearing instrument as located in the human ear.

Referring now especially to FIG. 5, the placement of the apparatus within the human ear is described. The ear includes the outer ear 502, middle ear 504, and inner ear 506. Also shown are the skull bone 508, malleus 510, incus 512, stapes 514, semicircular canals 516, auditory nerve to the brain 518, cochlea 520, Eustachian tube 522, round window 524, oval window 526, tympanic membrane 528, auditory canal 530, and pinna 532. These parts of the human ear and their functions are well known to those skilled in the art and will not be described further herein.

It will be appreciated that in one aspect the hearing instrument apparatus 100 is disposed within the canal 530. In some aspects, all microphones and receivers may be disposed in the apparatus 100 and, consequently, all are disposed within the canal 530 rather than behind the ear.

Preferred embodiments of this disclosure are described herein, including the best mode known to the inventor(s). It should be understood that the illustrated embodiments are exemplary only, and should not be taken as limiting the scope of the appended claims.

What is claimed is:

1. An acoustic apparatus, comprising;

a mechanical shell generally cylindrical in shape and forming a cavity having an inner surface;

a first electronic component disposed in the cavity;

a first connector including electrical contacts disposed adjacent the inner surface of the cavity;

the first electronic component electrically coupled to the first connector;

a receiver disposed in the cavity, the receiver having a second connector electrically coupled to the first connector;

the first connector movable relative to the second connector while the first connector is electrically coupled to the second connector;

wherein rotation of the shell causes the first connector to rotate relative to the second connector such that the receiver remains electrically coupled to the first electrical component via the first connector and the second connector during rotation.

2. The acoustic apparatus of claim 1, wherein a contact interconnects a first conductor of the first connector and a second conductor of the second connector during rotation of the first connector relative to the second connector.

3. The acoustic apparatus of claim 1, wherein the first electronic component is a microphone, a digital signal processor, or integrated circuit.

4. The acoustic apparatus of claim 1, further comprising a second electronic component disposed in the cavity.

5. The acoustic apparatus of claim 4, wherein the second electronic component is a microphone, a digital signal processor, or integrated circuit.

6. The acoustic apparatus of claim 1, wherein the shell is configured to be disposed at least partially in the human ear.

7. The acoustic apparatus of claim 1, further comprising an end portion disposed at a first end of the shell.

8. An acoustic apparatus comprising;

a mechanical shell generally cylindrical in shape and forming a cavity, the shell having an inner surface, the inter surface in communication with the cavity;

a microphone that is disposed in the cavity;

a first connector including electrical contacts that is disposed on the inner surface of the shell;

a first wire that electrically couples the microphone to the first connector;

a receiver disposed in the cavity, the receiver having a second connector;

a second electrical connection that is formed between the microphone and the receiver via the first connector and the second connector;

such that a rotation of the shell causes the electrical contacts to rotate within or with the second connector such that the rotation does not cause the second electrical connection between the first connector and the second connector to be broken;

wherein the apparatus is configured to be disposed in or at a human ear.

9. The acoustic apparatus of claim 8, wherein the second electrical connection includes a direct contact between the first connector and the second connector.

10. The acoustic apparatus of claim 8, further comprising a second electronic component that is disposed in the cavity.

11. The acoustic apparatus of claim 10, wherein the second electronic component is a second microphone, a digital signal processor, or integrated circuit.

12. The acoustic apparatus of claim 8, further comprising an end portion disposed at a first end of the shell.

13. An acoustic apparatus comprising;

a housing having a housing cavity;

an electronic component disposed at least partially within the housing cavity;

a first electrical connector disposed within the housing cavity, the first electrical connector electrically coupled to the electronic component;

a receiver having a second electrical connector, the second electrical connector disposed on an outer surface of the receiver, at least a portion of the receiver disposed within the housing cavity, the first electrical connector adjacent the second electrical connector, the first electrical connector electrically coupled to the second electrical connector, the first electrical connector movable relative to the second electrical connector while the first electrical connector is electrically coupled to the second electrical connector, wherein the electronic component remains electrically coupled to the receiver via the first electrical connector and the second electrical connector when the first electrical connector moves relative to the second electrical connector.

14. The acoustic apparatus of claim 13, the housing cavity defines a curved inner surface portion, the first electrical connector has a first conductor portion adjacent the curved inner surface portion of the housing cavity, the receiver has a curved outer surface portion, the second electrical connector has a second conductor portion disposed on the curved outer surface portion of the receiver, the first conductor portion adjacent and electrically coupled to the second conductor portion, the first conductor portion movable relative to the second conductor portion while the first conductor portion is electrically coupled to the second conductor portion.

15. The acoustic apparatus of claim 14, at least one of the first conductor portion or the second conductor portion has a curved shape, the first conductor portion electrically coupled to the second conductor portion by a contact slidably interconnecting the first conductor portion and the second conductor portion.

16. The acoustic apparatus of claim 13, the housing cavity has a generally cylindrical shape, the first electrical connector has a first conductor portion disposed partially about an axis of the housing cavity, the receiver has a generally cylindrical shape, the second electrical connector has a second conductor portion disposed partially about an axis of the receiver, the axis of the receiver aligned generally with the axis of the housing cavity wherein the first conductor portion is adjacent the second conductor portion.

17. The acoustic apparatus of claim 16, the first conductor portion rotatable relative to the second conductor portion while the first conductor portion is electrically coupled to the second conductor portion, wherein the electronic component remains electrically coupled to the receiver via the first conductor portion and the second conductor portion when the first conductor portion rotates relative to the second conductor portion.

18. The acoustic apparatus of claim 17, a contact physically interconnecting the first conductor portion and the second conductor portion, the contact fixedly disposed on one of the first conductor portion or the second conductor portion, the contact slidably engaged with the other of the first conductor portion or the second conductor portion, wherein the first conductor portion and the second conductor portion remain electrically coupled when the first conductor portion rotates relative to the second conductor portion.

19. The acoustic apparatus of claim 13, the first electrical connector disposed within the housing cavity in fixed relation to the housing, wherein movement of the housing relative to the receiver causes movement of the first electrical connector relative to the second electrical connector.

20. The acoustic apparatus of claim 13 is an in-the-ear hearing device, wherein the housing has a generally cylindrical outer surface shaped for at least partial insertion in a user's ear canal, and the electronic component includes a microphone.

* * * * *